United States Patent [19]

Speers et al.

[11] 4,452,559

[45] Jun. 5, 1984

[54] ATTACHMENT ASSEMBLY FOR BELLCRANK ARM

[75] Inventors: Leonard E. Speers, Terre Haute; Philip D. Redenbarger, Centerpoint, both of Ind.

[73] Assignee: J.I. Case Company, Racine, Wis.

[21] Appl. No.: 414,699

[22] Filed: Sep. 3, 1982

[51] Int. Cl.[3] ..... E02F 3/86

[52] U.S. Cl. ..... 414/710; 403/347; 414/706

[58] Field of Search ..... 414/697, 700, 706, 707, 414/710, 713; 403/83, 84, 282, 347, 207, 398, 400

[56] References Cited

U.S. PATENT DOCUMENTS

| | | | |
|---|---|---|---|
| 3,009,590 | 11/1961 | Kampert | 414/700 |
| 3,568,869 | 3/1971 | Beiley et al. | 414/701 |
| 3,713,557 | 1/1973 | Seaberg et al. | 414/700 |
| 3,792,792 | 2/1974 | Bromberek et al. | 414/700 |
| 3,811,587 | 5/1974 | Seaberg | 414/700 |
| 3,872,990 | 3/1975 | York | 414/700 |
| 4,372,729 | 2/1983 | Buschbom et al. | 414/710 X |
| 4,375,344 | 3/1983 | Baum et al. | 414/708 |

FOREIGN PATENT DOCUMENTS

| | | | |
|---|---|---|---|
| 1564601 | 4/1980 | United Kingdom | 403/398 |

*Primary Examiner*—Robert J. Spar
*Assistant Examiner*—Terrance L. Siemens
*Attorney, Agent, or Firm*—Cullen, Sloman, Cantor, Grauer, Scott & Rutherford

[57] ABSTRACT

An attachment assembly for adjustably securing the control arm and bellcrank arm of an anti-rollback linkage for material handling buckets. The anti-rollback control arm includes a generally flat planar arm portion and a position adjusting shaft with the longitudinal axis of the position adjusting shaft being perpendicular to the longitudinal axis of the arm portion. The bellcrank arm is generally U-shaped in cross-section and includes openings through side wall flanges for receiving an end portion of the position adjusting shaft. The shaft end portion is adjustably secured to the bellcrank arm by a U-bolt fastener which extends in a direction perpendicular to the axis of the position adjusting shaft and which is attached to the bellcrank arm. The position adjusting shaft end portion includes spaced apart knurled peripheral band areas which are separated by at least one smooth peripheral area. As the U-shaped bolt fastener is tightened and pulled against the position adjusting shaft end portion, the knurled areas are embedded into the metal surrounding the openings through the bellcrank arm flanges thereby securely fastening the position adjusting shaft to the bellcrank arm at a desired location and preventing the position adjusting shaft from slipping on the bellcrank arm. The knurled peripheral band areas on the shaft end portion permit an almost infinite adjustment in spacing between the control arm and bellcrank arm during final assembly. Further, the attachment assembly between the control arm and bellcrank arm, including the shaft end portion, knurled peripheral band areas, and U-bolt fastener, provides an inexpensive means for positioning the control arm at a desired location for performing an anti-rollback function.

1 Claim, 4 Drawing Figures

ATTACHMENT ASSEMBLY FOR BELLCRANK ARM

BACKGROUND OF THE INVENTION

The present invention relates generally to material handling equipment and, more particularly, to an improved attachment assembly for adjustably securing a bellcrank arm that is used in an anti-rollback linkage for controlling the position of a bucket supported on a boom.

Various anti-rollback control mechanisms have been proposed for preventing a material handling bucket from being pivoted beyond a predetermined maximum rollback position or for maintaining the bucket at a level position. One such arrangement includes an anti-rollback control arm which is connected by a bucket position linkage to a bucket for sensing the bucket position. The control arm is also connected to a bellcrank arm which, in turn, actuates a control valve and bucket cylinder for rotating the bucket forwardly if the bucket rolls back beyond a predetermined position. For the anti-rollback arrangement just described, it is desirable that the control arm be adjustably secured to the bellcrank arm so that the control arm may be conveniently positioned relative to a lift arm pivot to act as a mechanical stop against bucket rollback.

Thus, the present invention is directed to an inexpensive attachment assembly between the control arms and bellcrank arm of an anti-rollback linkage for material handling equipment which permits substantially infinite adjustable positioning between the control arm and bellcrank arm while preventing slippage therebetween.

SUMMARY OF THE INVENTION

In accordance with the present invention, an anti-rollback linkage for material handling mechanisms is disclosed including a main anti-rollback control arm which is connected to a bellcrank arm for controlling the actuation of a bucket cylinder to roll or tilt the bucket appropriately for self-leveling. The anti-rollback control arm is positioned forwardly of a lift arm pivot pin and includes a bent section that can engage the lift arm pivot pin to act like a mechanical stop against bucket rollback.

The anti-rollback control arm includes a generally flat planar arm portion and a position adjusting shaft with the longitudinal axis of the position adjusting shaft being perpendicular to the longitudinal axis of the arm portion. The bellcrank arm is generally U-shaped in cross-section and includes openings through its side wall flanges for receiving an end portion of the position adjusting shaft. The shaft end portion is adjustably secured to the bellcrank arm by a U-bolt fastener which extends in a direction perpendicular to the axis of the position adjusting shaft and which is attached to the bellcrank arm.

The spacing between the planar control arm portion and bellcrank arm may be adjusted by sliding the position adjusting shaft end portion relative to the bellcrank arm until the desired spacing is reached, and then tightening the U-bolt fastener against the midsection of the shaft end portion. The position shaft end portion includes spaced apart knurled peripheral band areas which are separated by a smooth peripheral area. As the U-bolt fastener is tightened and pulled against the midsection of the shaft end portion, the knurled areas are embedded into the metal surrounding the openings through the bellcrank arm flanges thereby securely fastening the position adjusting shaft to the bellcrank arm at the desired location and preventing the shaft from slipping on the bellcrank arm.

The knurled peripheral band areas permit an almost infinite adjustment in the spacing between the planar control arm portion and the bellcrank arm during final assembly. Further, the attachment assembly between the control arm and bellcrank arm including the position shaft end portion, the knurled peripheral band areas, and the U-bolt fastener, provides an inexpensive means for positioning the control arm at a desired location relative to the lift arm pivot for performing its anti-rollback function.

Other advantages and meritorious features of the attachment assembly of the present invention will be more fully understood from the following description of the preferred embodiment, the appended claims, and the drawings, a brief description of which follows.

DETAILED DESCRIPTION OF THE INVENTION

Figure 1:
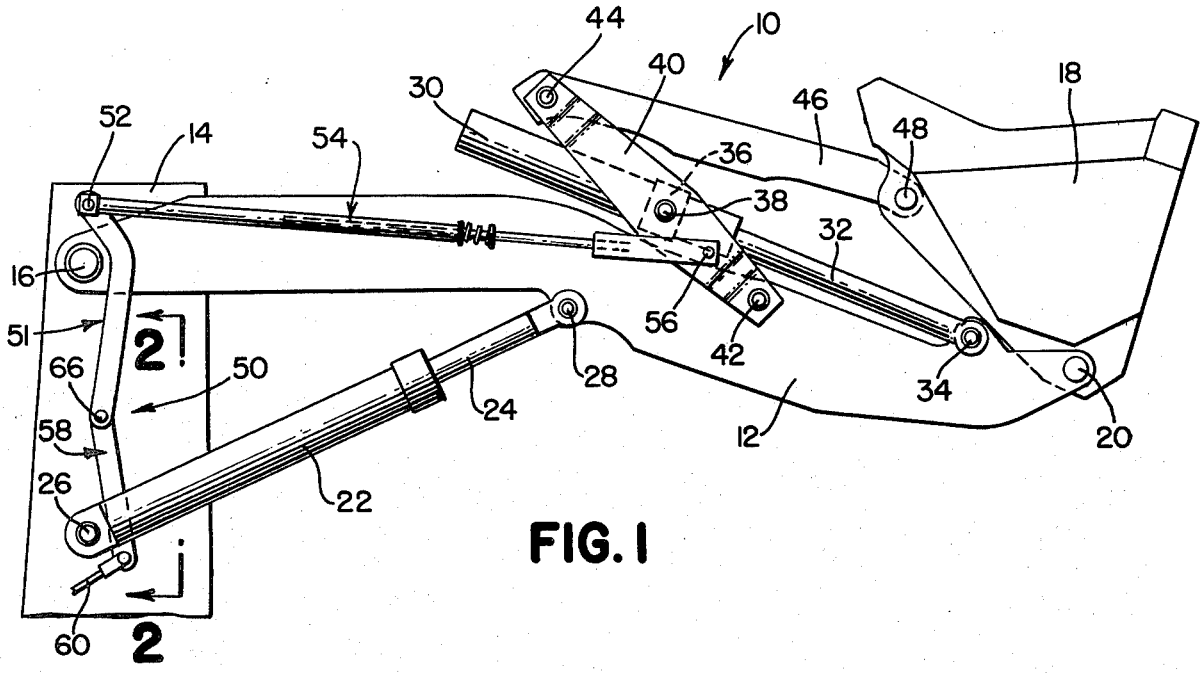
FIG. 1 is a partial side elevational view of a tractor including an anti-rollback linkage.
Figure 2:
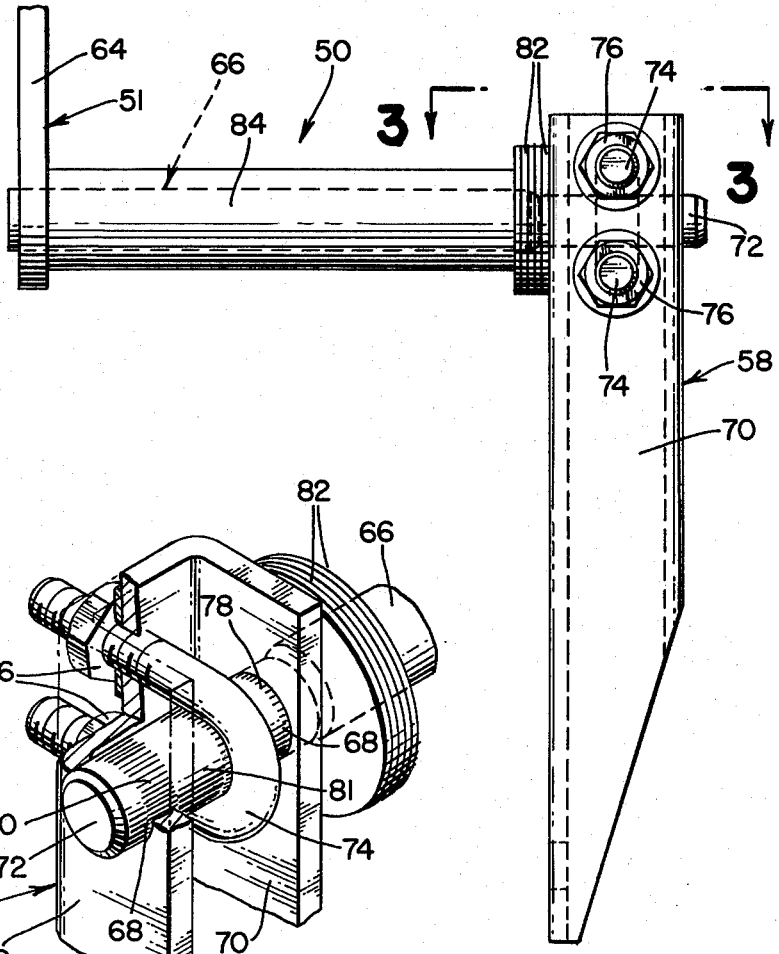
FIG. 2 is a view taken along line 2—2 in FIG. 1 illustrating the control arm and bellcrank arm of the anti-rollback linkage.
Figure 3:
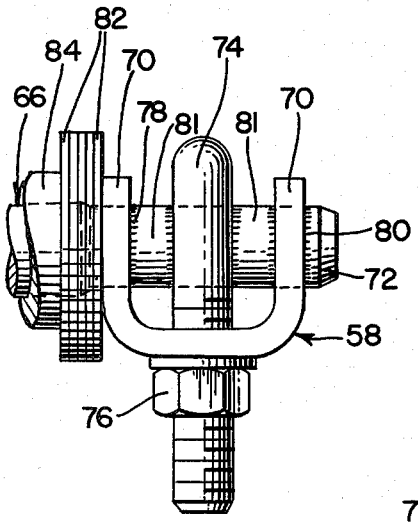
FIG. 3 is a top plan view of the attachment assembly between the control arm and bellcrank arm as viewed along line 3—3 in FIG. 2.
Figure 4:
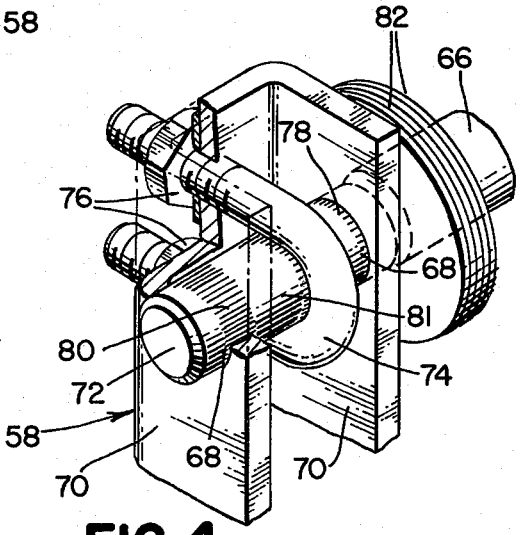
FIG. 4 is a perspective view of the attachment assembly between the control arm and bellcrank arm.

Referring to FIG. 1, there is shown a material handling mechanism 10 which is mounted to the front end of a tractor (not shown). Material handling mechanism 10 includes a lift arm or boom 12 pivotally supported at one end to tractor frame 14 by means of a pivot shaft 16. A bucket 18 is pivotally supported at the other end of the boom or lift arm 12 by means of a pivot pin 20.

Lift arm 12 is pivoted about the pivot shaft 16 by operation of hydraulic cylinder 22 through extension or retraction of a piston rod 24. The lower end of the lift arm cylinder 22 is pivotally connected to tractor frame 14 by pin 26 while the outer end of lift arm cylinder piston rod 24 is pivotally secured to an intermediate portion of the lift arm 12 by pin 28. While only one lift arm 12 and one lift cylinder 22 are shown, it will be appreciated that lift arms and lift cylinders are located on opposite sides of the tractor as is conventional.

The pivotal movement of bucket 18 about pin 20 is controlled by hydraulic bucket cylinder 30 having a piston rod 32 pivotally connected by pin 34 to lift arm 12 and a cylinder trunnion 36 mounted by pin 38 on link 40. Link 40 forms part of a compound linkage, and it is pivotally connected by pin 42 to lift arm 12 while its opposite end is pivotally connected by pin 44 to a second link 46 which, in turn, is pivotally connected to bucket 20 by pin 48.

Application of hydraulic pressure to the rod end of bucket cylinder 30 causes bucket 18 to pivot forwardly relative to lift arm 12 from a carry position where the top of the bucket is substantially level with the ground through a dig position into a dump position. Conversely, application of hydraulic pressure to the piston end of cylinder 30 causes bucket 18 to pivot in a reverse direction from the dump position through the dig to the carry position.

Referring to FIGS. 1–4, an anti-rollback bellcrank linkage 50, made in accordance with the teachings of the present invention, is provided for the material handling mechanism 10. Anti-rollback linkage 50 includes a main anti-rollback control arm 51 which is pivotally connected by pin 52 to one end of bucket position linkage 54. The other end of bucket position linkage 54 is connected to link 40 by pin 56. A bellcrank arm 58 is connected to control arm 51 and further connected to a control valve (not shown) by means of linkage 60 (FIG. 1) for controlling the actuation of bucket cylinder 30 to roll or tilt bucket 18 appropriately for self-leveling.

If the tractor is parked or inoperative with lift arm 12 in an extreme raised position, the normal fluid leakage both in the control valve (not shown) and bucket cylinder 30 will permit some rearward rollback of bucket 18. Since the hydraulic system is inoperative, the bucket position link 54 pushes the main anti-rollback control arm 51 back against lift arm pivot 16. Anti-rollback control arm 51 is positioned forwardly of pivot 16 and includes a bent section 62 that can engage pivot shaft 16 under the circumstances just described. Thus, anti-rollback control arm 51 acts like a mechanical stop against bucket rollback when the tractor is inoperative and the lift arm 12 is raised.

The anti-rollback control arm 51 includes a generally flat planar arm portion 64 and a position adjusting shaft 66 with the longitudinal axis of the position adjusting shaft 66 being perpendicular to the longitudinal axis of the arm portion 64. Bellcrank arm 58 is generally U-shaped in cross-section and includes openings 68 through its side wall flanges 70 for receiving the end portion 72 of position adjusting shaft 66. End portion 72 is adjustably secured to bellcrank arm 58 by a U-bolt fastener 74 which extends in a direction perpendicular to the axis of shaft 66 and which is attached to bellcrank arm 58.

The spacing between arm portion 64 and bellcrank arm 58 may be adjusted by sliding shaft end portion 72 relative to bellcrank arm 58 until the desired spacing between arm portion 64 and bellcrank arm 58 is reached, and then tightening fastener nuts 76 for pulling the bight of U-shaped fastener bolt 74 against the midsection of end portion 72. End portion 72 includes spaced apart knurled peripheral band areas 78 and 80 separated by at least one smooth peripheral area 81. As the U-shaped bolt fastener 74 is tightened and pulled against the midsection of end portion 72, the knurled areas 78 and 80 are embedded into the metal surrounding the openings 68 through flanges 70 thereby securely fastening shaft 66 to bellcrank arm 58 at the desired location and preventing shaft 66 from slipping on bellcrank arm 58. The spacing between control arm portion 64 and bellcrank arm 58 may be further maintained by adding or subtracting one or more of the washers 82 which abut the sleeve 84 that surrounds shaft 66 between arm portion 64 and bellcrank arm 58.

The knurled peripheral band areas 78 and 80 on end portion 72 permit an almost infinite adjustment in the spacing between arm portion 64 and bellcrank arm 58 during final assembly. Further, the attachment assembly, including shaft end portion 72, knurled peripheral band areas 78 and 80, and U-shaped bolt fastener 74, provides an inexpensive means for positioning the anti-rollback control arm 51 at a desired location relative to the lift arm pivot 16 for performing the anti-rollback function as described.

It will be apparent to those skilled in the art that the foregoing disclosure is exemplary in nature rather than limiting, the invention being limited only by the appended claims.

We claim:

1. In a material handling mechanism including at least one lift arm, pivot means securing said lift arm to a frame, a bucket pivotally supported on said lift arm, a lift cylinder for raising and lowering said lift arm, a bucket cylinder for rolling said bucket forwardly or rearwardly relatively to said lift arm, and an anti-rollback linkage including a control arm and bellcrank arm for maintaining the bucket in a level condition and for preventing the bucket from being rolled rearwardly beyond a predetermined maximum rollback position as the lift arm is moved to an extreme raised position, the improvement comprising:

said control arm including an arm portion and a position adjusting shaft member with the longitudinal axis of said position adjusting shaft member being perpendicular to the longitudinal axis of said arm portion, said bellcrank arm generally U-shaped in cross-section and including side wall flanges having openings therethrough for receiving an end portion of said position adjusting shaft member, said end portion adjustably secured to said bellcrank arm by a U-shaped fastener which extends around and engages said end portion and is disposed generally perpendicularly to the axis of said end portion for attachment to said bellcrank arm, said end portion including spaced apart knurled peripheral band areas which are separated by at least one smooth peripheral area, and said knurled peripheral band areas being embedded into said flanges upon tightening said fastener for securely fastening said end portion to said bellcrank arm at a desired location.

* * * * *